United States Patent [19]

Sanders

[11] Patent Number: 4,470,439

[45] Date of Patent: Sep. 11, 1984

[54] ADJUSTABLE GUIDES

[75] Inventor: Anthony J. Sanders, Darlington, England

[73] Assignee: Black & Decker Inc., Newark, Del.

[21] Appl. No.: 407,669

[22] Filed: Aug. 12, 1982

[30] Foreign Application Priority Data

Aug. 17, 1981 [GB] United Kingdom ..... 8125090

[51] Int. Cl.[3] ..... B27C 5/10

[52] U.S. Cl. ..... 144/136 C; 144/134 D; 409/182

[58] Field of Search ..... 144/134 D, 136 C; 409/182

[56] References Cited

U.S. PATENT DOCUMENTS

| | | | |
|---|---|---|---|
| 2,587,994 | 3/1952 | Gregory | 144/136 C |
| 2,943,655 | 7/1960 | Pedersen et al. | 144/134 D |
| 3,376,787 | 4/1968 | Morganson | 144/136 C |
| 3,478,788 | 11/1969 | Zelik | 144/136 C |

FOREIGN PATENT DOCUMENTS

| | | |
|---|---|---|
| 1037969 | 8/1966 | United Kingdom . |
| 1103967 | 2/1968 | United Kingdom . |
| 1112219 | 5/1968 | United Kingdom . |
| 1162796 | 8/1969 | United Kingdom . |

*Primary Examiner*—W. D. Bray

*Attorney, Agent, or Firm*—Edward D. Murphy; Harold Weinstein; Charles E. Yocum

[57] ABSTRACT

A guide system for guiding the movement of an article such as a router includes a carrier for a guide plate, an arrangement for coupling the carrier to the router and means for enabling the location of the carrier relative to the coupling arrangement to be finely adjusted. This fine adjustment is provided in addition to the coarse adjustment between the router body and the coupling arrangement that it is known to employ.

10 Claims, 12 Drawing Figures

ADJUSTABLE GUIDES

FIELD OF THE INVENTION

This invention relates to adjustable guides and has particular reference to adjustable guides for use with power tools for carrying out routing and like operations.

BACKGROUND OF THE INVENTION

Routers are usually provided with a guide carried by mounting rods that extend laterally from the router and by means of which the movement of the router is, during use, controlled to follow a required path. The rods pass into passageways in the base of the router and are held in a set position by means of locking screws fitted to the base.

With such an arrangement, the distance between the router and the guide is quickly adjustable but accurate positioning of the guide is difficult.

SUMMARY OF THE INVENTION

Accordingly, it is an object of the present invention to provide a guide system which allows the quick adjustment of the previous methods and which also allows fine adjustment.

According to the present invention, there is provided a guide system for guiding the movement of an article, the system including a carrier for a guide plate, an arrangement for coupling the carrier to the article whose movement is to be controlled by the guide plate, and means for enabling the location of the carrier relative to the coupling arrangement to be finely adjusted.

The quick and approximate adjustment of the previous methods is therefore still allowed provided the coupling arrangement is secured to the article in a suitable way, and in addition a fine adjustment is provided between the carrier and the coupling arrangement.

Preferably, the means for enabling the location of the carrier to be finely adjusted also permits adjustment of the orientation of the carrier relative to the arrangement to be changed.

In one embodiment of the invention, the arrangement comprises at least one elongate mounting member, the carrier being movable along the mounting member.

Preferably, two such mounting means in the form of parallel, spaced rods are used.

In one particular embodiment, the rods are screw-threaded over a part at least of their lengths and the carrier is located on the rods by parts mounted on the screw-threaded portions of the rods and rotatably mounted on the carrier, rotation of the parts thereby moving the carrier along the length of the rods. The parts may be in the form of knobs.

Where the enabling means also allows the orientation of the carrier relative to the arrangement to be varied, the means may be pivotally joined to the carrier. For example, the knobs referred to above may have a peripheral groove in which a projection on the carrier is located, the arrangement being such that the darrier may be pivoted relative to the rods about the projection.

It is a further feature of the invention that the guide plate may be detachably secured to the carrier.

Alternatively, the carrier may include one guide plate. This guide plate and/or the carrier may be provided with means permitting the attachment of one or other of a number of different guide plates.

According to another aspect of the invention there is provided a power tool including a guide system for guiding the movement of the tool, the guide system comprising a guide plate and carrier assembly, an arrangement for coupling the assembly to the tool body and means for enabling the location of the tool body relative to the coupling arrangement to be adjusted and means for enabling the location of the carrier relative to the coupling arrangement to be finely adjusted.

Coarse adjustment means may be provided for adjusting the location of the tool body on the coupling arrangement and fine adjustment means may be provided for adjusting the location of the carrier on the coupling arrangement.

BRIEF DESCRIPTION OF THE DRAWINGS

By way of example only, an adjustable guide system for a router will now be described in greater detail with reference to the accompanying drawings of which.

DETAILED DESCRIPTION OF THE PREFERRED EMBODIMENTS

Figure 1:
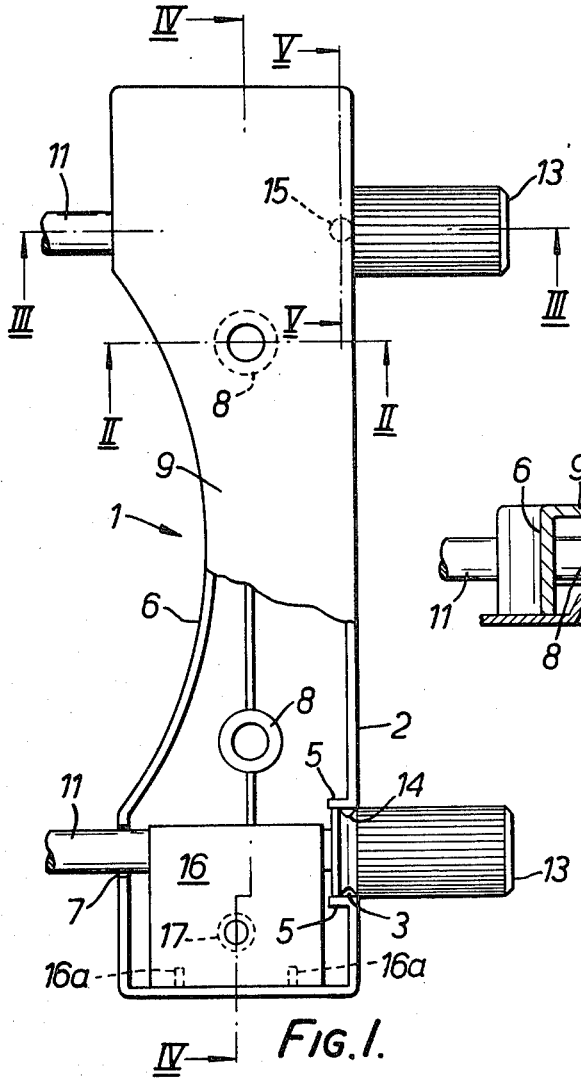
FIG. 1 is a composite view of a carrier, the upper part of the Figure being a plan view and the lower part being a view from underneath.
Figure 2:
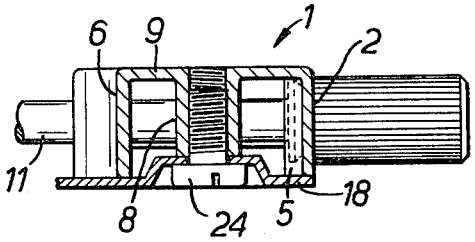
FIGS. 2, 3, 4 and 5 are sections on the lines II—II, III—III, IV—IV and V—V respectively of FIG. 1.
Figure 3:
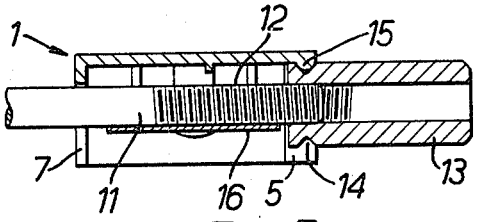

Referring first to FIGS. 1–5, it will be seen that the carrier comprises a casting 1 of elongate form open over its lower face.

One side wall 2 of the casting 1 is straight and has openings 3, 4 each bounded by side flanges 5. The other side wall 6 has a centre curved portion that terminates, at each end, in straight portions each with an opening 7 one of which is aligned with opening 3 and the other with opening 4.

Figure 4:
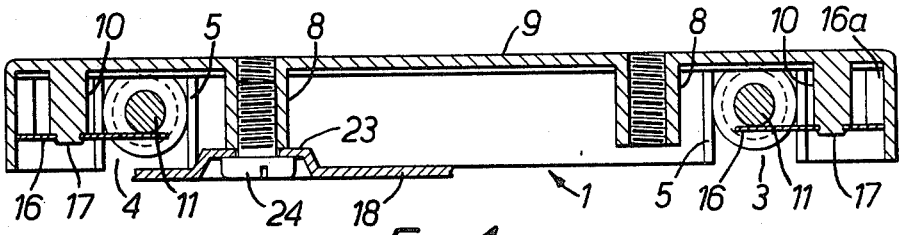
Figure 5:
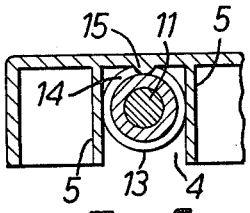

Hollow integral bosses 8 extend inside the casting 1 from the upper wall 9 thereof and are internally screw-threaded as shown in FIG. 4. The bosses do not extend for the full depth of the casting as can also be seen from FIG. 4.

Further integral bosses 10 are located adjacent each end wall of the casting and extend into the latter for a distance just slightly less than the length of bosses 8.

Extending through the casting 1 at right angles to the side wall 2 are rods 11 part only of the full length of which is seen in the drawings. One of the rods is located in the aligned openings 3, 7 while the other rod is located in aligned openings 4, 7. One end of each rod is screw-threaded as indicated at 12. Over the threads 12 are screwed knurled adjusting knobs 13 each of which has, adjacent its inner end, a shallow peripheral V-groove 14 which co-operates with a small "pip" 15 formed in the casting 1 centrally of the upper edge of each of the openings 3, 4.

The rods 11 are supported in the casting 1 by support plate springs 16 mounted upon the bosses 10 and secured thereto by upsetting the ends thereof. The plate springs are positioned by lugs 16*a* on the casting 1.

T'.e carrier is intended to carry one or other of different guides and examples of such guides are shown in FIGS. 6–10.

Figure 6:
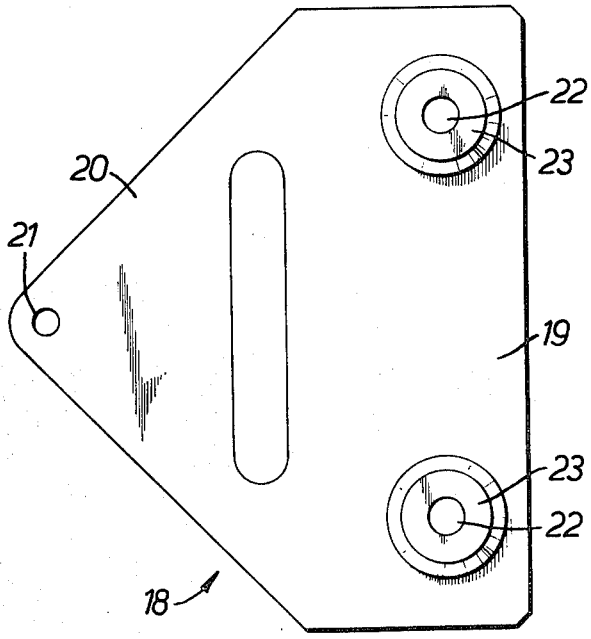
FIG. 6 is a plan view of a guide.

The guide 18 shown in FIG. 6 is intended to be used to guide an associated router round a circular path. The guide 18 is of sheet metal with a generally rectangular body part 19 with a pointed nose portion 20. In the apex of the nose portion 20 is a hole 21. Spaced holes 22 in the body part 19 are located in raised portions 23 of the body part 19 as indicated at 23. The distance between the holes 22 enables the guide 18 to be secured to the carrier by means of screws that pass through the holes 22 and into the threaded bores of the bosses 8. The height of the raised portions 23 is such that when screwed to the carrier, the guide locates closely beneath the carrier. This is shown, in part, in FIGS. 2 and 4 in which screws 24 are shown as securing the guide 18 to the carrier. The hollows formed by the raised portions 23 accommodate the heads of the screws 24 driving a flush finish to the lower surface of the guide 18.

Figure 7:
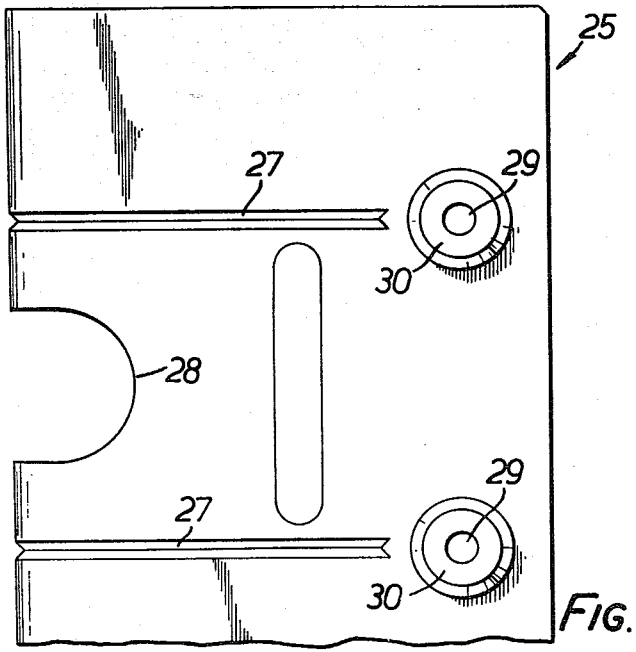
FIGS. 7 and 8 are, respectively, plan and side views of part of another form of guide.
Figure 8:
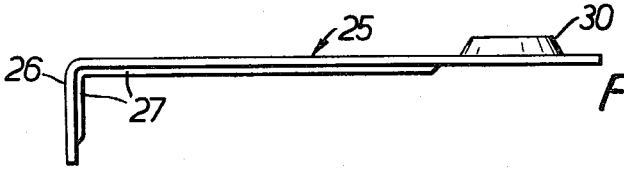

A guide 25 suitable for guiding an associated router along a linear path is shown in FIGS. 7 and 8. The guide 25 is of sheet metal and of generally rectangular form. One edge—the guide edge—has a downwardly-extending flange 26, the flange 26 and the guide 25 having impressed V formations 27 for strengthening purposes. The guide edge also has a central cut-out 28. To allow the guide 25 to be attached to the carrier, it has holes 29 located in raised portions 30, these being similar in position and purpose as the holes 22 and raised portions 23 of the guide 18.

The guide 25 may be secured to the carrier in a manner identical with that described above with reference to the guide 18.

Figure 9:
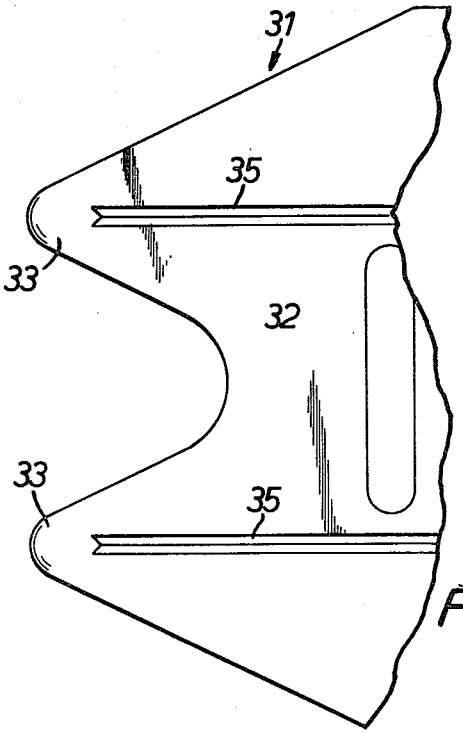
FIGS. 9 and 10 are respectively plan and side views of part of a further form of guide.
Figure 10:
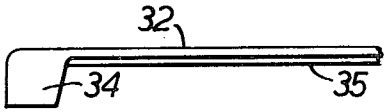

FIGS. 9 and 10 show the front part only of another guide 31 that is used to guide an associated router along a curved path. Guide 31 has a nose portion 32 shown in FIG. 9 and a body portion not shown that is similar to the body portion 19 of the guide 18. The nose portion 32 has spaced rounded projections 33 each flanged as at 34 over its extremity. Guide 31 has strengthening V-formations 35 similar to the formations 27 of guide 25.

The body portion of guide 31 has spaced holes located in raised portions and these enable the guide to be secured to the carrier in a manner identical with that described above with reference to guide 18.

Figure 11:
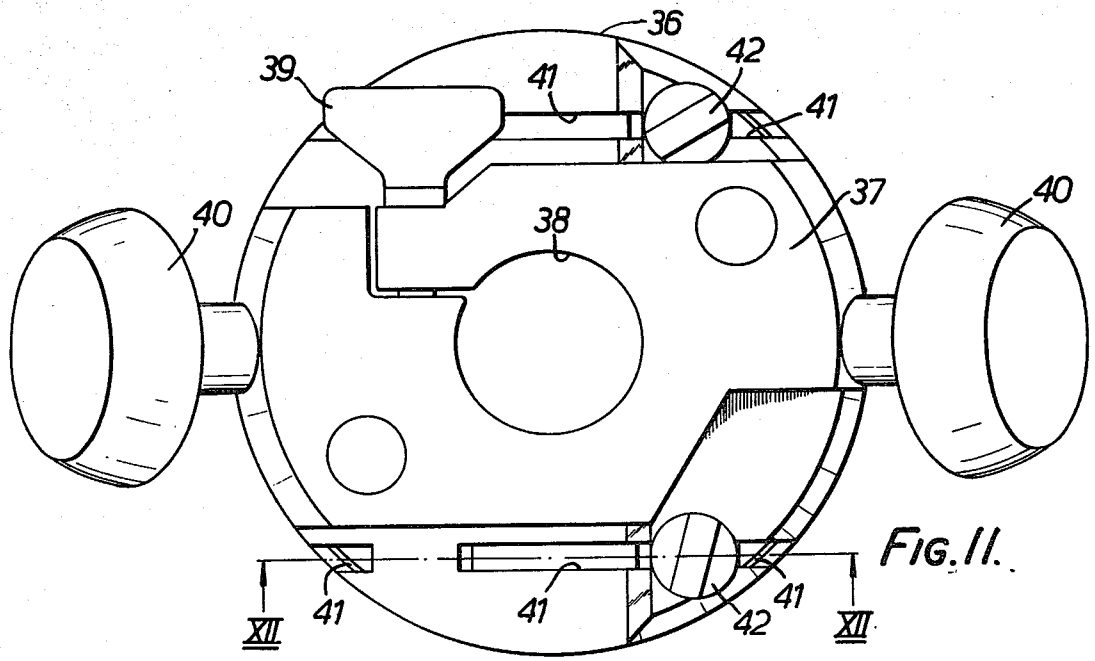
FIG. 11 is a plan view of the support table of a router.
Figure 12:
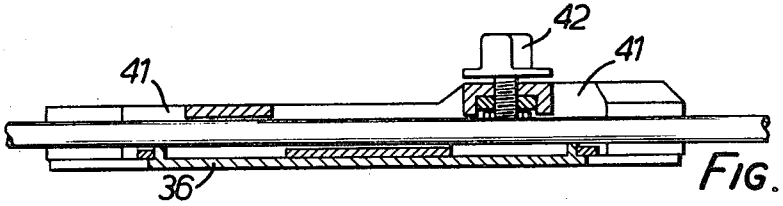
FIG. 12 is a section on the line XII—XII of FIG. 11

The carrier is coupled to a router by means of the rods 11 referred to above. FIGS. 11 and 12 show, by way of example only, the parts of a typical router to illustrate the way in which the coupling is effected.

The router has a circular base 36 from which columns (not shown) extend upwardly from diametrically-opposed positions on the base. The columns support a holder 37 for a driving motor (not shown). The holder is in the form of a clamp having a central hole 38 through which extends the motor chuck. The clamp has an adjusting screw 39 enabling the clamp to be closed down on to and grip the motor. Holder 37 also has handles 40 by means of which the router is manipulated during use.

The base 36 is formed with passageways 41 to receive the rods 11 and associated with each passageway is a clamp 42 by means of which each rod may be clamped in a desired position in the passageway.

To use the carrier, a desired guide is first attached thereto as described above, after which the rods 11 are entered into the passageways 41 and clamped in positions that give the required spacing between the guide surface along which the guide is to travel and the bit of the router. Thus positioning is normally found to be approximate only and it is then necessary to secure an accurate positioning. That is achieved in the following manner: by rotating the knobs 13 the position of the guide relative to the rods 11 may be varied. The "pips" 15 couple the knobs 13 to the carrier so that rotation of the knobs in one direction will move the carrier along the rods towards the router whilst rotation of the knobs in the other direction will draw the carrier away from the router.

Equal rotation of the knobs 13 will cause the carrier to advance towards or retreat from the router, the orientation of the carrier with respect to the rods remaining unchanged. However, if the knobs 13 are rotated by different amounts, the orientation of the carrier with respect to the rods will change. Such a change in orientation may be desirable and is obtained by reason of the way in which the carrier is coupled to the knobs, i.e. the engagement of the "pips" 15 in the grooves 14.

The pitch of the screw threads on the ends of the rods is such as to provide for small accurate movement of the carrier.

It will be appreciated that once the knobs 13 have been rotated to position the casting, the latter remains in that position and no further clamping is required.

It will also be understood that, if desired, the casting may have a particular guide permanently secured to it or formed as an integral part of the casting. In this case, the guide or the casting may be so formed as to allow other guides to be secured thereto when needed.

While the guide system described above is used to guide the movement of a router it will be understood that the system may be used to guide the movement of other power tools or other articles.

In place of each "pip" 15, it may be preferred to provide a pair of ridges in the form of a right angled V with each ridge tangential to a respective part of the V-groove 14 and of similar cross-section to the "pips" 15.

I claim:

1. A guide system for guiding the movement of an article, the system including:

a carrier;

a guide plate carrier by said carrier;

an arrangement for coupling the carrier to the article whose movement is to be controlled by the guide plate;

said coupling arrangement comprising two parallel spaced rods and the carrier being movable therealong;

said rods being screw-threaded over a portion at least of their lengths; and the carrier being located on the rods by parts mounted on the screw-threaded portions of the rods and rotatably mounted on the carrier, rotation of said parts thereby moving the carrier along the length of the rods to enable the location of the carrier relative to said coupling arrangement to be finely adjusted.

2. A system as claimed in claim 1 in which the parts are in the form of knobs.

3. A system as claimed in claim 2 in which the knobs have a peripheral groove in which a projection on the carrier is located, whereby the carrier may be pivoted relative to the rods about the projection to change the orientation of the carrier relative to the coupling arrangement.

4. A system as claimed in claim 1 in which the guide plate is detachably secured to the carrier.

5. A router having a tool body and including a guide system for guiding the movement of the router, the guide system comprising:

a guide plate and carrier assembly;

an arrangement for coupling said assembly to the tool body;

first means for enabling the location of the tool body relative to the coupling arrangement to be coarsely adjusted;

second means for enabling the location of said assembly relative to said coupling arrangement to be finely adjusted and for permitting adjustment of the orientation of said assembly relative to said coupling arrangement;

said coupling arrangement comprising two spaced apart rods on which said assembly is mounted and along which said assembly is movable; and said second means comprising screw-threaded portions on said rods and adjusting members threadedly engaged thereon, said adjusting members being rotatably mounted in said assembly and rotation of said adjusting members moving said assembly relative to said rods.

6. A power tool having a tool body and including a guide system for guiding the movement of the power tool, the guide system comprising:

a guide plate and carrier assembly;

an arrangement for coupling the assembly to the tool body;

means for enabling the location of the tool body relative to the coupling arrangement to be adjusted;

said coupling arrangement comprising two elongate mounting rods which are parallel and spaced apart, the carrier and the tool body being movable along the mounting rods; and said rods being screw-threaded over a portion at least of their lengths and the carrier being located on the rods by parts mounted on the screw-threaded portions of the rods and rotatably mounted on the carrier, rotation of said parts thereby moving the carrier along the length of the rods to enable the location of the carrier relative to the coupling arrangement to be finely adjusted.

7. A power tool as claimed in claim 6 in which the parts are in the form of knobs.

8. A power tool as claimed in claim 7 in which the knobs have a peripheral groove in which a projection on the carrier is located, whereby the carrier may be pivoted relative to the rods about the projection to change the orientation of the carrier relative to the coupling arrangement.

9. A power tool as claimed in claim 8 in which the tool is a router.

10. A router, comprising:

a tool body;

a guide plate and carrier assembly for guiding movement of the tool body;

said carrier comprising a top and two spaced apart side walls with two pairs of aligned openings in the side walls;

two parallel spaced apart rods adjustably connected at one end to the tool body whereby the position lengthwise of the rods relative to the tool body is adjustable, the other end of each rod being screwthreaded, and said rods extending through said two pairs of aligned openings;

adjusting knobs rotatably mounted in the two openings in one of said side walls, and engaging the screwthreaded ends of said rods;

means, operative between each said knob and the opening in which it is rotatably mounted, for retaining each knob in its respective opening;

plate springs mounted in said carrier below said top and between said side walls, said plate springs engaging and supporting said rods; and course adjustment of said guide plate and carrier assembly relative to said tool body being effected by adjusting said rods relative to said tool body, and fine adjustment being effected by rotating said adjusting knobs on said rods.

* * * * *